US005664502A

United States Patent [19]

Wilhelm

[11] Patent Number: 5,664,502

[45] Date of Patent: Sep. 9, 1997

[54] WHEEL ASSEMBLY CAPABLE OF MAINTAINING ENGAGEMENT WITH A RAIL HAVING AN UNEVEN PORTION THEREIN

[75] Inventor: John J. Wilhelm, New Kensington, Pa.

[73] Assignee: Westinghouse Electric Corporation, Pittsburgh, Pa.

[21] Appl. No.: 280,895

[22] Filed: Jul. 27, 1994

[51] Int. Cl.[6] ..... B61C 11/00

[52] U.S. Cl. ..... 105/30; 105/73; 105/150; 105/154; 104/95

[58] Field of Search ..... 105/30, 73, 75, 105/148, 150, 154; 104/89, 93, 95

[56] References Cited

U.S. PATENT DOCUMENTS

| | | | |
|---|---|---|---|
| 2,655,871 | 10/1953 | Mazzola | 105/30 |
| 3,540,603 | 11/1970 | Neumeier | 105/154 |
| 3,851,906 | 12/1974 | Frish et al. . | |
| 4,023,503 | 5/1977 | Grop | 105/30 |
| 4,318,346 | 3/1982 | Sessum | 105/73 |
| 4,576,100 | 3/1986 | Zanin | 105/49 |
| 4,654,188 | 3/1987 | Hankinson . | |
| 4,664,873 | 5/1987 | Hendrich et al. . | |
| 4,715,288 | 12/1987 | Catena | 105/154 |

*Primary Examiner*—S. Joseph Morano

[57] ABSTRACT

Wheel assembly capable of maintaining engagement with a rail having an uneven portion therein. The wheel assembly includes a frame adapted to pivot about a pivot axis defined by the frame. At least one wheel is rotatably connected to the frame for traversing the rail. The wheel maintains engagement with the rail as the wheel traverses the uneven portion of the rail because the frame pivots about the pivot axis as the wheel encounters the uneven portion of the rail. Service tooling may be suspended from the wheel assembly to service a nuclear reactor pressure vessel located below the rail.

8 Claims, 7 Drawing Sheets

WHEEL ASSEMBLY CAPABLE OF MAINTAINING ENGAGEMENT WITH A RAIL HAVING AN UNEVEN PORTION THEREIN

BACKGROUND OF THE INVENTION

This invention relates to trolleys or wheel assemblies and more particularly relates to a wheel assembly capable of maintaining engagement with a rail as the wheel assembly traverses an uneven portion in the rail, which rail may be a circular rail disposed above a nuclear reactor pressure vessel for suspending service tooling from the rail to service the pressure vessel. Periodically, nuclear reactor pressure vessels require servicing, such as refueling a nuclear reactor core disposed therein. The reactor pressure Vessel includes a shell having an open end and a shell flange surrounding the open end of the shell. A hemispherical closure head sealingly caps the open end of the pressure vessel, the closure head having a closure head flange surrounding the perimeter thereof. The flange of the closure head has a plurality of spaced-apart holes therethrough. The closure head is attached to the shell by a plurality of externally threaded studs extending through the holes in the closure head flange and into the flange of the shell. A plurality of internally threaded nuts threadably engage respective ones of the studs and are tightened against the closure head flange for securing the closure head to the shell. In order to refuel the reactor core, the nuts are unthreaded from their respective studs for removing the closure head from the shell to allow access to the reactor core.

After refueling or other servicing operations, the closure head is replaced on the open of the shell such that the studs extend through their respective holes in the closure head flange. However, before the nuts are threadably run-down their respective studs, the studs are first pretension in a manner well known in the art so that the nuts will intimately engage the closure head flange when the nuts are run-down the studs. During the pretensioning process, each stud is threadably engaged with its associated nut; however, the nut is not completely run-down the stud. A stud pretensioning device is hoisted above the stud and attached to an end portion of the stud that projects upwardly from the nut. Tension is then applied to the end portion of the stud by operating the pretensioning device, so that the stud elastically lengthens a predetermined amount. After a predetermined amount of tension is applied to the stud for lengthening the stud, the nut is completely run-down the stud to intimately engage the closure head flange. The pretensioning device is then removed from the stud, such that the stud elastically returns to substantially its original length exerting a compressive force against the nut. This process is repeated for each stud and nut combination. In this manner, pretensioning each stud followed by a run-down of the nut on the stud securely attaches the closure head to the open end of the pressure vessel shell. The above process can also be used in reverse order to detach the closure head from the pressure vessel shell.

As stated hereinabove, the pretensioning device is hoisted above the stud that is to be pretensioned. In this regard, a circular rail is positioned above the closure head and a hoist mechanism is connected to the rail, the hoist mechanism engaging a cable that extends downwardly from the hoist. A grappler or hook is attached to an end of the cable for connecting the hoist mechanism to the pretensioning device. The hoist mechanism itself includes a roller assembly connected thereto for rolling the hoist mechanism around the circular rail, so that the pretensioning device can be positioned on a selected stud. Such prior art rolling assemblies may have at least one wheel engagable with the rail for rolling the hoist mechanism therealong. It is desirable that the wheel maintains traction with the rail so that the hoist mechanism travels around the rail without slippage in order to precisely align the pretensioning device with the selected stud.

However, applicants have observed that the rail may have a raised, bumpy or uneven portion therein impeding the movement of the roller assembly therealong. When such prior art roller assembly encounters the uneven portion, it may loose traction and slip. On occasion, such an uneven portion may be severe enough to halt the travel of the roller assembly, thereby necessitating time-consuming manipulation of the roller assembly to force it past the uneven portion.

Therefore, what is needed is a wheel assembly capable of maintaining engagement with a rail as the wheel assembly traverses an uneven portion in the rail, which rail may be a circular rail disposed above a nuclear reactor pressure vessel for suspending service tooling from the rail to service the pressure vessel.

SUMMARY OF THE INVENTION

Disclosed herein is a wheel assembly capable of maintaining engagement with a rail having an uneven portion therein. The wheel assembly includes a frame adapted to pivot about a pivot axis defined by the frame. At least one wheel is rotatably connected to the frame for traversing the rail. The wheel maintains engagement with the rail as the wheel traverses the uneven portion of the rail because the frame pivots about the pivot axis as the wheel encounters the uneven portion in the rail. Service tooling may be suspended from the wheel assembly to service a nuclear reactor pressure vessel located below the rail.

The invention in its broad form is a wheel assembly capable of maintaining engagement with a rail as the wheel assembly traverses an uneven portion in the rail, comprising a frame adapted to pivot about a pivot axis defined by the frame; a wheel rotatably connected to the frame for engaging the rail and traversing therealong; and adjustment means connected to the frame for adjusting said wheel, so that the wheel engages the rail, whereby the frame and the wheel connected thereto traverse the rail as the wheel rotates, whereby the frame and the wheel pivot about the pivot axis as the wheel traverses the uneven portion in the rail, and whereby the wheel maintains engagement with the rail as the wheel traverses the uneven portion and as the frame pivots about the pivot axis.

An object of the present invention is to provide a wheel assembly capable of maintaining engagement with a rail as the wheel assembly traverses an uneven portion in the rail.

A feature of the present invention is the provision of a frame adapted to pivot about a pivot axis defined by the frame, the frame having at least one wheel rotatably connected to the frame for engaging the rail, so that the frame and the wheel pivot about the pivot axis as the wheel traverses the uneven portion in the rail.

An advantage of the present invention is that the wheel maintains engagement with the rail as the wheel traverses the uneven portion and as the frame pivots about the pivot axis, so that the wheel assembly traverses the rail without slippage or loss of traction.

These and other objects, features, and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing out and distinctly claiming the subject matter of the invention, it is believed the invention will be better understood from the following description taken in conjunction with the accompanying drawings wherein:

DESCRIPTION OF THE PREFERRED EMBODIMENTS

Figure 1:
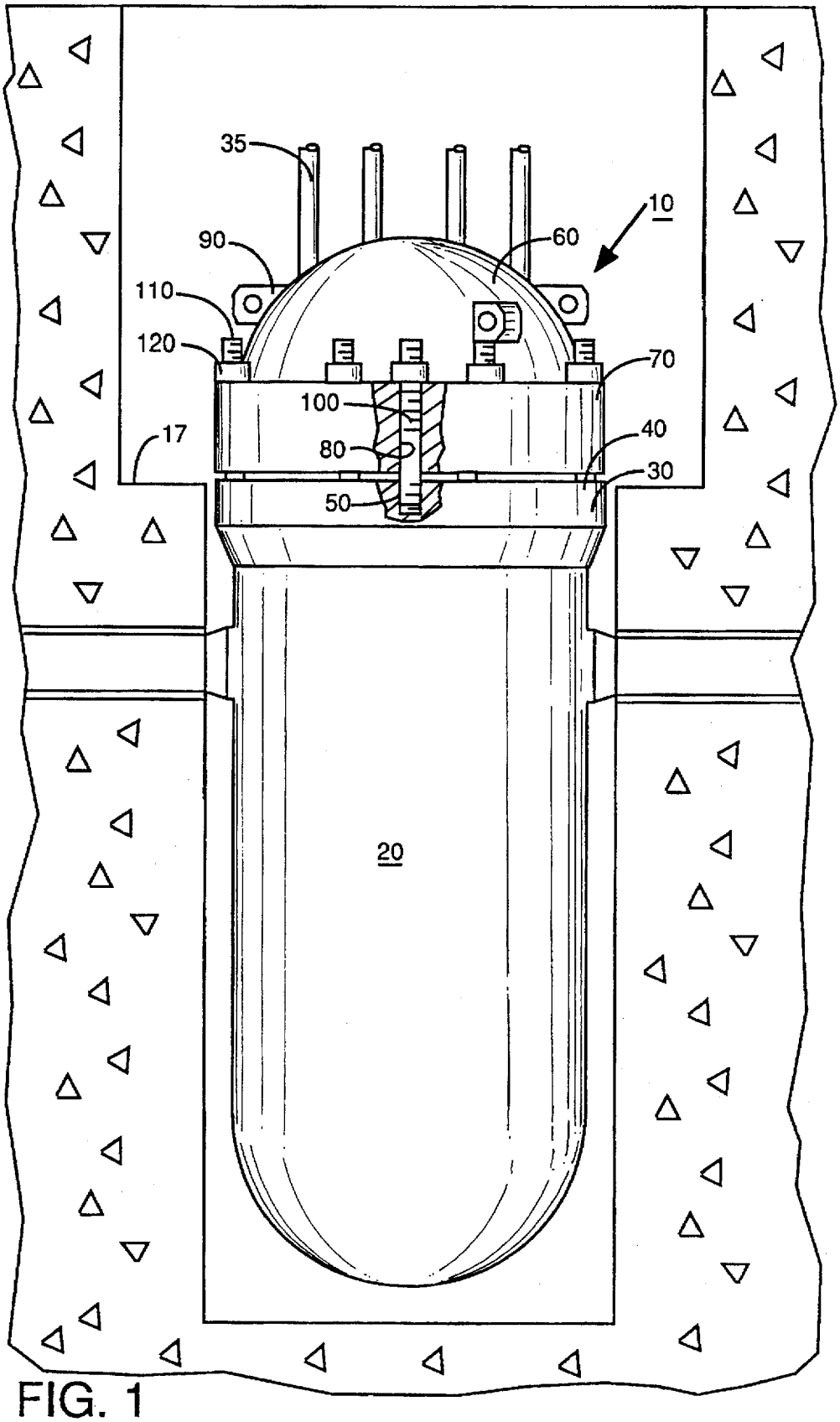
FIG. 1 shows in full elevation a nuclear reactor pressure vessel disposed in a reactor cavity, the pressure vessel comprising a shell and a closure head mounted on the shell and further comprising a plurality of stud and nut combinations connecting the closure head to the shell.

Referring to FIG. 1, there is shown a nuclear reactor pressure vessel, generally referred to as 10, disposed in a reactor cavity 15. Reactor cavity 15 has an annular ledge 17 formed therein for providing a work platform for service personnel. Pressure vessel 10 includes a pressure vessel shell 20 having an open top end 30 for allowing access to a nuclear reactor core (not shown) disposed in shell 20. A plurality of control drive mechanisms 35 (only four of which are shown) penetrate pressure vessel 10 for controlling the nuclear reaction occurring in the reactor core. A pressure vessel flange 40 surrounds the open top end of shell 20, flange 40 having a plurality of spaced-apart holes 50 formed therein. Capping open end 30 of shell 20 is a hemispherical closure head 60. A closure head flange 70 surrounds the perimeter of closure head 60, flange 70 having a plurality of spaced-apart holes 80 therethrough. In addition, a plurality of attachment members 90 outwardly project from closure head 60 for reasons disclosed presently. Extending through respective ones of holes 80 and into holes 50 are a plurality of studs 100 each having an externally threaded end portion 110. Threadably engaging end portion 110 of stud 100 is an internally threaded nut 120 capable of being run-down stud 100 and engaging closure head flange 70 for attaching closure head 60 to open end 40 of shell 30. However, each stud 100 is preferably pretensioned so that nut 120 will intimately engage flange 70 of the closure head 60 when nut 120 is run-down the stud 100 for securely attaching closure head 60 to open top end 30 of shell 20.

Figure 2:
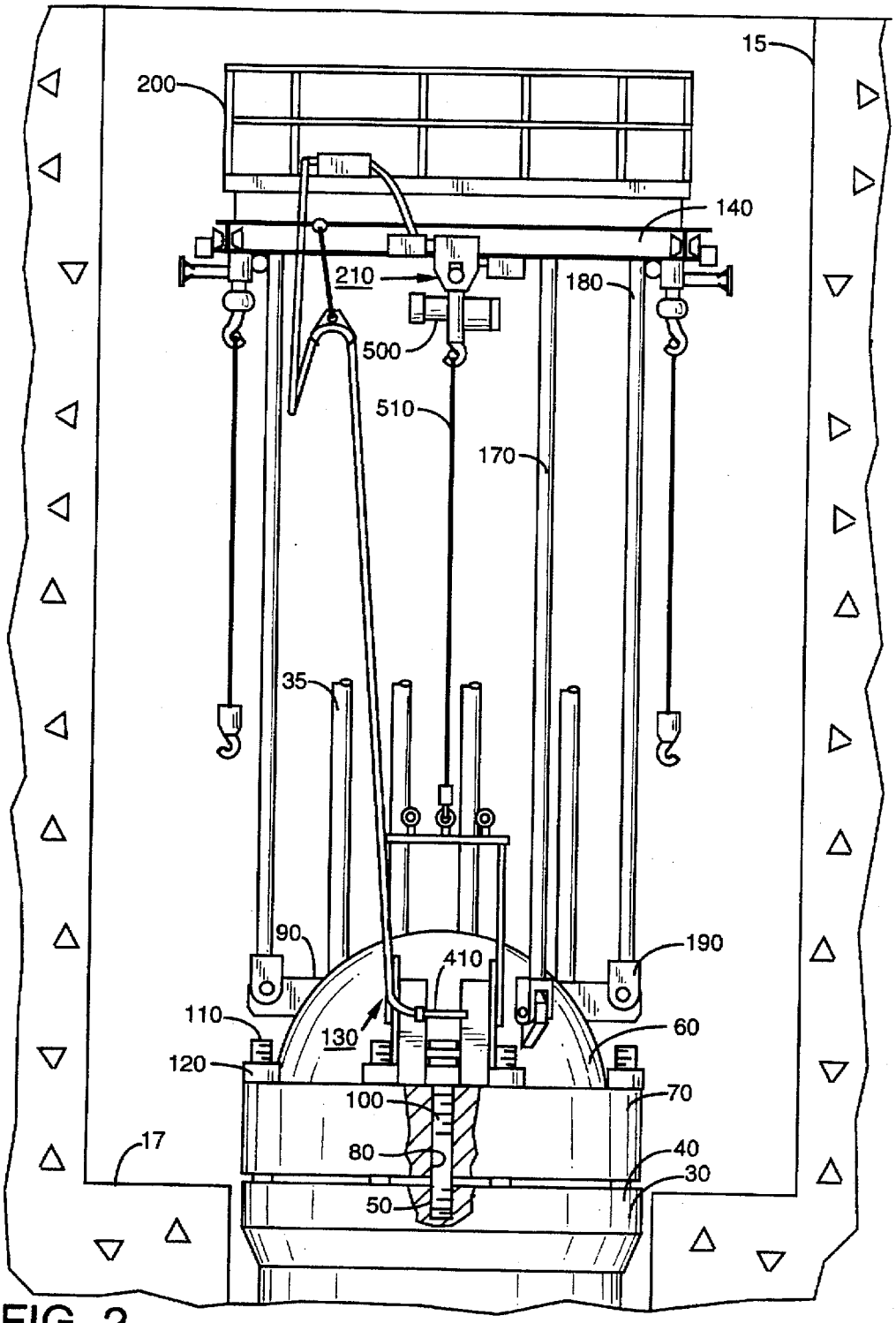
FIG. 2 shows in full elevation a circular rail disposed above the closure head, the rail engaged by a wheel assembly having a hoist connected thereto, the hoist having a stud pretensioning tool suspended therefrom.

Referring to FIG. 2, a stud pretensioning device, generally referred to as 130, is hoisted above stud 100 and is attached to end portion 110 of stud 100. Stud 100 that is to be pretensioned is allowed to be threadably engaged with nut 120; however, nut 120 is not completely run-down stud 100. Tension is applied to end portion 110 of the stud 100 by operating pretensioning device 130, so that stud 100 elastically lengthens a predetermined amount. After a predetermined amount of tension is applied to stud 100, nut 120 is completely run-down stud 100 to intimately engage closure head flange 70. Pretensioning device 130 is then removed from stud 100, such that stud 100 elastically returns to substantially its original length for exerting a downwardly-acting compressive force against nut 120. This process is repeated for each stud 100 and nut 120 combination, However, before pretensioning device 130 is caused to engage end portion 110 of stud 100, it must first be hoisted above end portion 110 and then lowered onto end portion 110.

Figure 3:
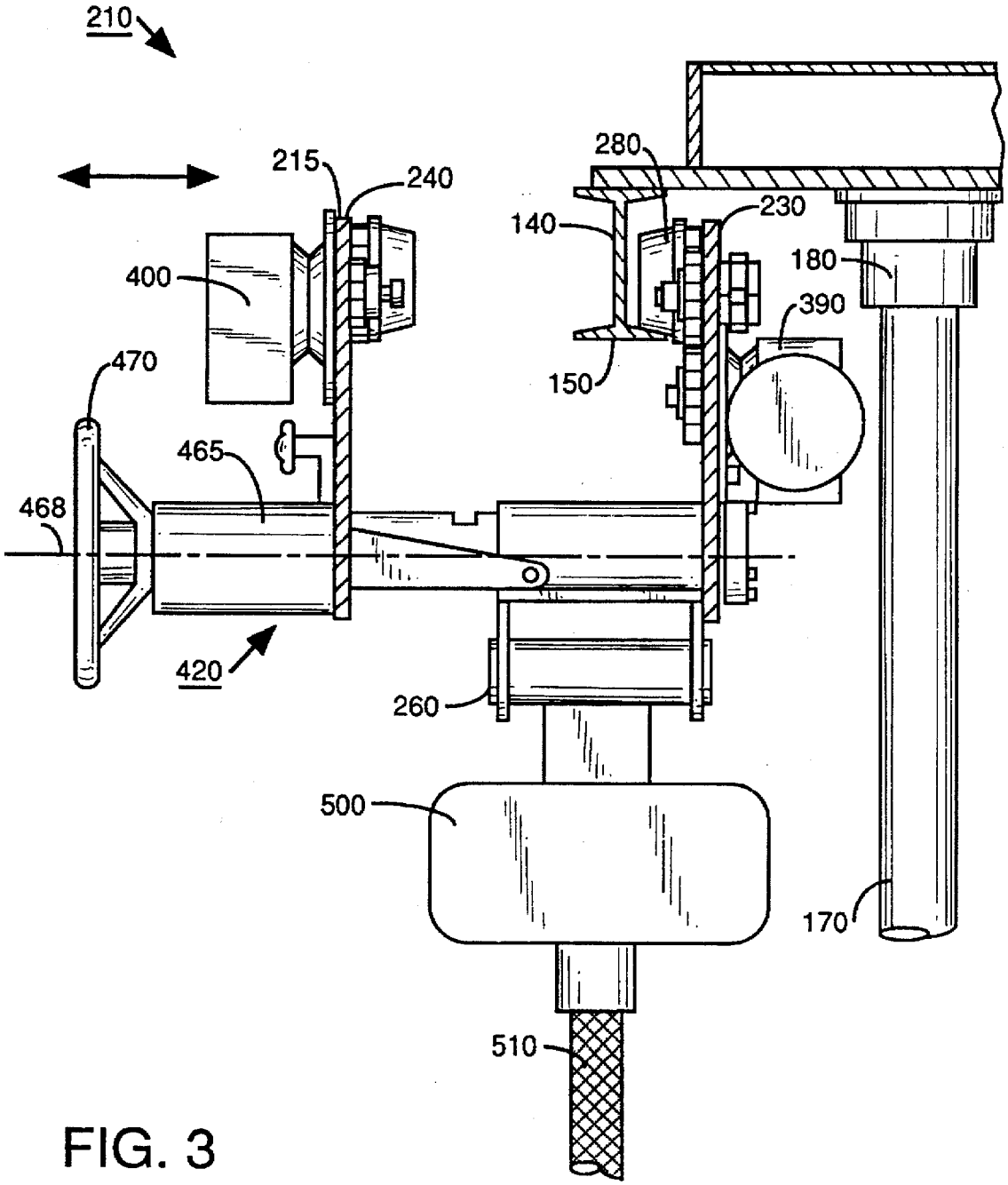
FIG. 3 is a view in partial elevation of the wheel assembly in an open position prior to engaging the rail.
Figure 4:
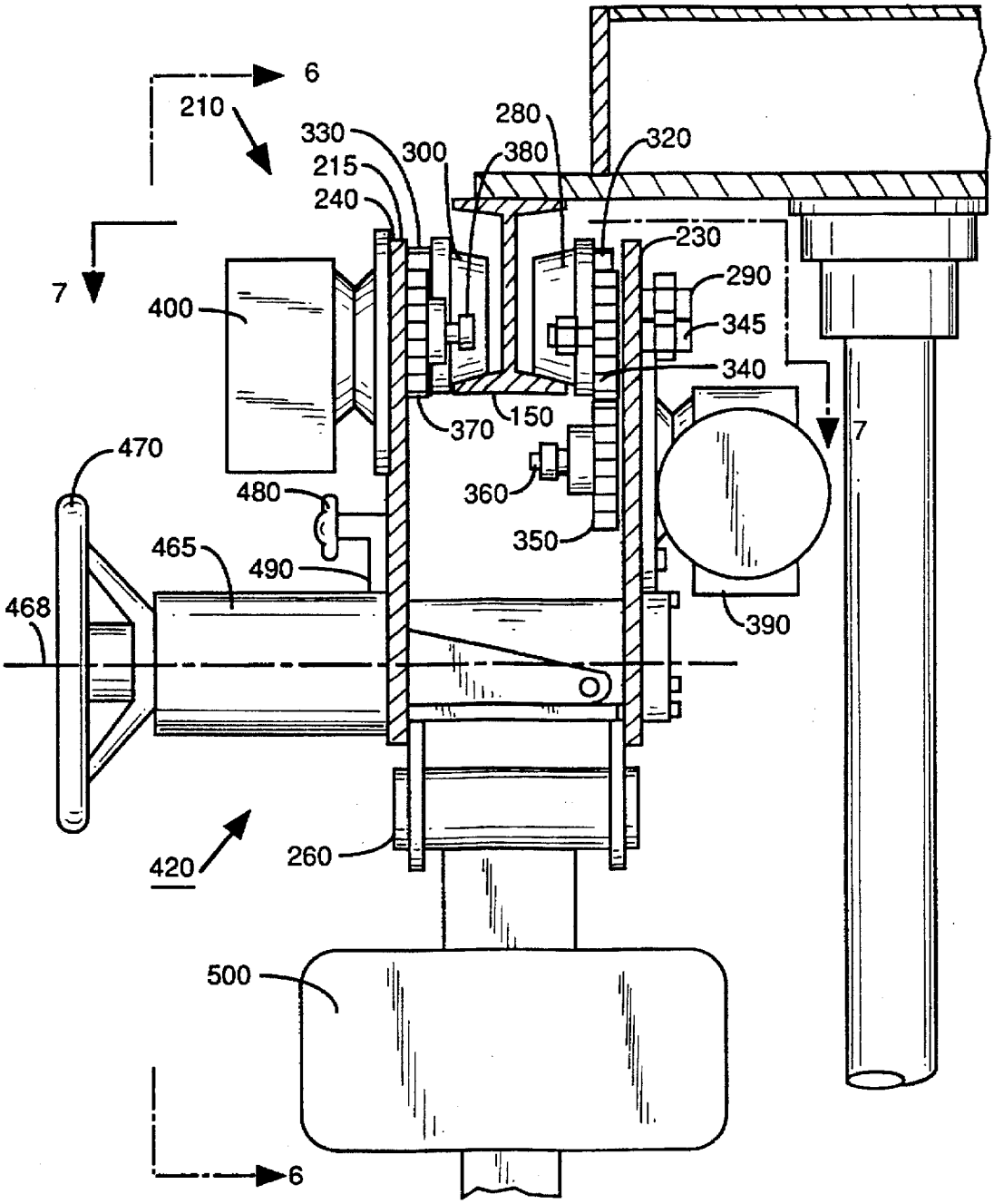
FIG. 4 is a view in partial elevation of the wheel assembly in a closed position after engaging the rail.

Referring to FIGS. 2 and 3, a generally circular rail 140 is disposed above closure head 60 to allow pretensioning device 130 to be hoisted above end portion 110 of stud 100 and then lowered downwardly onto end portion 110. Rail 140 may be "I"-shaped in transverse cross section for defining a bottom flange 150 integrally attached therewith. However, flange 150 may not be perfectly even or flat. That is, flange 150 may have at least one raised, bumpy or uneven portion 160 (see FIGS. 6 and 7) therein. Moreover, as shown in FIGS. 2 and 3, interconnecting rail 140 and closure head 60 are a plurality of rigid support legs 170 (only three of which are shown) for supporting rail 140 above closure head 60. Each support leg 170 has a first end portion 180 attached to rail 140 and a second end portion 190 removably connected to a respective one of the attachment members 90. Rail 140 may include a work platform 200 for supporting service equipment and personnel.

Referring now to FIGS. 2, 3, 4, 5, 6 and 7, there is shown the subject matter of the present invention, which is a wheel assembly, generally referred to as 210, for positioning pretensioning device 130 on stud 100. As described in detail hereinbelow, wheel assembly 210 is capable of maintaining engagement with flange 150 of rail 140 as wheel assembly 210 traverses uneven portion 160 in flange 150. Wheel assembly 210 comprises a frame 215 adapted to pivot about a pivot axis 468 (see FIG. 3) defined by frame 215, as described more fully hereinbelow. More specifically, frame 215 includes a fixed first plate 230. A movable second plate 240, which is spaced-apart from first plate 230, is disposed parallel to and opposite first plate 230. Second plate 240 has a pair of apertures 255*a,b* formed therethrough for reasons disclosed hereinbelow.

Referring to FIGS. 2, 3, 4, 5, 6, and 7, a first pair of wheels 280 are rotatably connected to first plate 230, such as by a first rotatable shaft 290. First pair of wheels 280 are capable of engaging flange 150 and traversing therealong. A second pair of wheels 300 are rotatably connected to second plate 240, such as by a rotatable second shaft 310. Second pair of wheels 300 are capable of engaging flange 150 and traversing therealong. A circular and rotatable first driven gear 320 extends around each of first shafts 290, so that each of the first pair of wheels 280 rotates as its respective first driven gear 320 rotates. A circular and rotatable second driven gear 330 extends around each of second shafts 310, so that each of the second pair of wheels 300 rotates as its respective second driven gear 330 rotates. A circular rotatable idler gear 340 may be connected to second plate 230, such as by a rotatable idler gear shaft 345, and is interposed between first driven gears 320 for simultaneously engaging first driven gears 320. In this manner, first driven gears 320 rotate as idler gear 340 rotates. A circular rotatable first drive gear 350 is connected to first plate 230, such as by a rotatable first gear shaft 360. First drive gear 350 engages idler gear 340 for rotating idler gear 340. A second drive gear 370 is connected to second plate 240, such as by a rotatable second gear shaft 380, and is interposed between second driven gears 330 for simultaneously rotating second driven gears 330 as second drive gear 376 rotates.

Referring again to FIGS. 2, 3, 4, 5, 6 and 7, a removable variable speed reversible first motor 390 is connected to first drive gear 350 for rotating first drive gear 350, so that idler gear 340 rotates as first drive gear 350 rotates. First driven gears 320 rotate as idler gear 340 rotates due to the engagement of idler gear 340 with first driven gears 320. A variable speed reversible second motor is connected to second drive gear 370 for rotating second drive gear 370, so that second driven gears 330 rotate as second drive gear 370 rotates. Moreover, electrically connected to first motor 390 and second motor 400 is control means, such as a controller generally referred to as 410, for controlling the operation of first motor 390 and second motor 400.

As best seen in FIGS. 3, 4, 5 and 6, wheel assembly 210 comprises adjustment means, generally referred to as 420, connected to second plate 240 for adjusting second pair of wheels 300, so that second pair of wheels 300 engage flange 150. In this manner, adjustment means 420 includes a sleeve 430 attached to first plate 230, such as by screws 435. Sleeve 430 is rotatably slidably disposed in arm 465 and has internal threads 440 and a notch 450 formed therein for reasons disclosed more fully hereinbelow. A rotatable lead screw 460 is rotatably connected to an arm 465, as at 466. Arm 465 is itself attached to second plate 240, as at 467. Lead screw 460 is disposed in sleeve 430 so that lead screw threadably engages internal threads 440 formed in sleeve 430. In this manner, second plate 240 is capable of advancing toward rail 140 as lead screw 460 is rotated in a first direction. As second plate 240 advances toward rail 140, it will cause first pair of wheels 300 to engage or contact flange 150. Also, second plate 240 is capable of retreating away from rail 140 to disengage first pair of wheels 300 from flange 150 as lead screw 460 is rotated in a second direction opposite the first direction. Thus, second plate 240 will preferably advance or retreat in the direction of the double headed arrow shown in FIG. 3. Lead screw 460 may include a handle 470 for turning or rotating lead screw 460.

Still referring to FIGS. 3, 4, 5 and 6, it will be appreciated from the description hereinabove that arm 465 defines a pivot axis 468 through the center thereof, so that wheel assembly 210 is capable of pivoting about pivot axis 468. Wheel assembly 210 pivots about pivot axis 468 due to the following two reasons: (1) arm 465, which is attached to second plate 240 at location 467, is rotatably connected to lead screw 460 at point 466 and (2) sleeve 430, which is attached to first plate 230, is threadably connected to lead screw 460. This structure of wheel assembly 210 allows plates 230/240 to independently pivot about pivot axis 468. Thus, arm 465 is radially rotatably around sleeve 430. This is an important feature of the invention for reasons disclosed hereinbelow.

Figure 5:
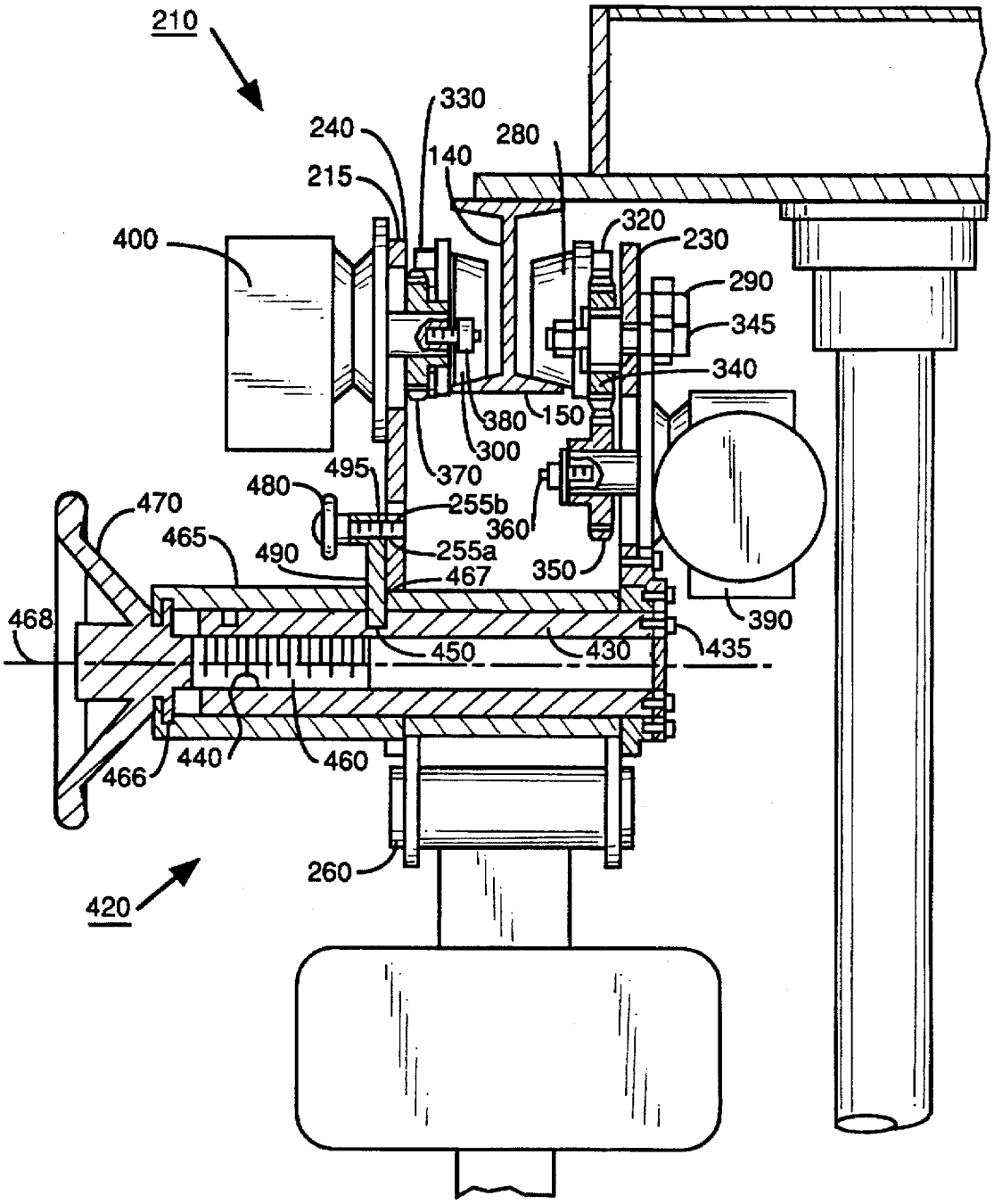
FIG. 5 is a view in elevation of the wheel assembly in the closed position engaging the rail.
Figure 6:
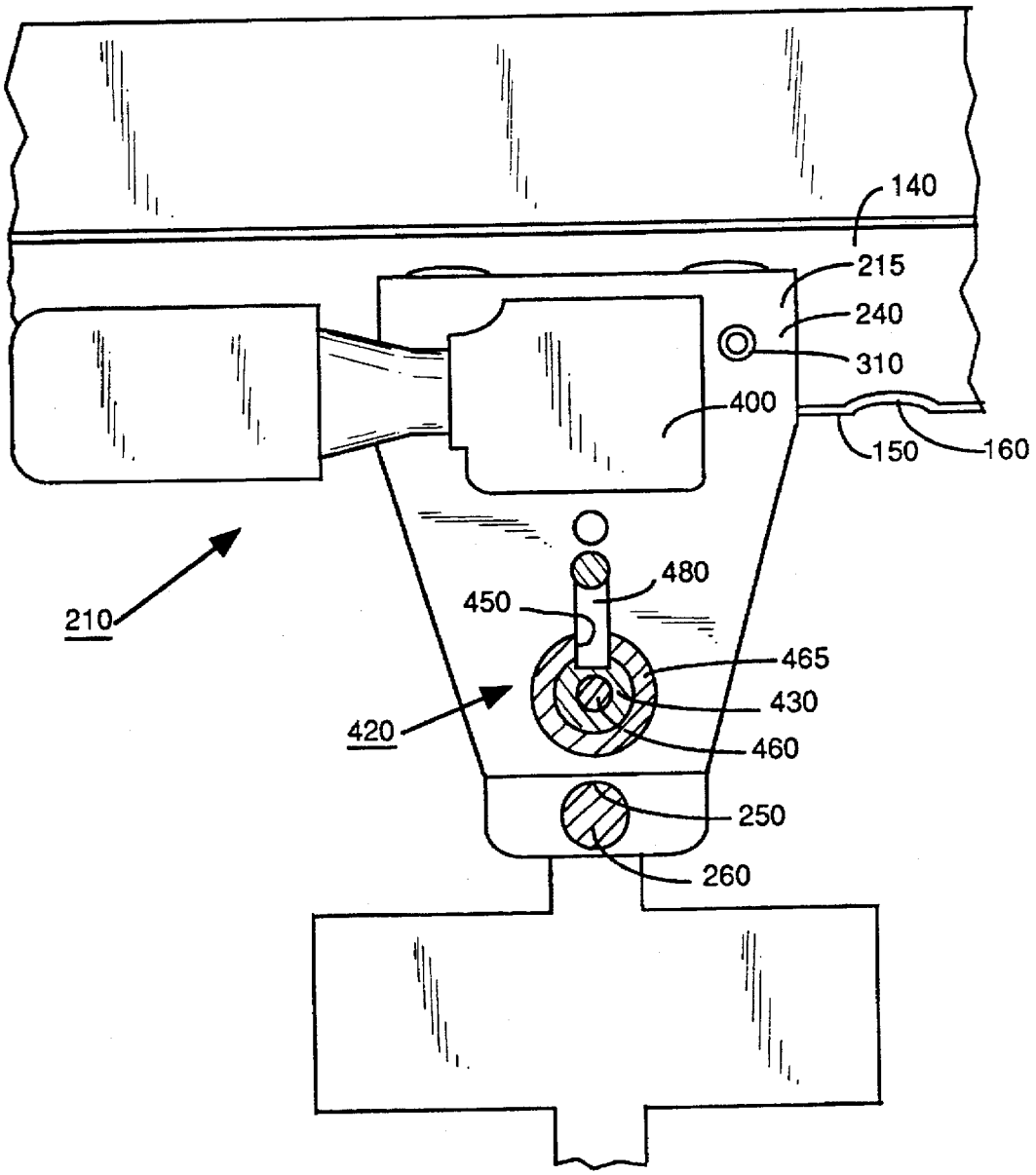
FIG. 6 is a view along section line 6—6 of FIG. 4.

As best seen in FIGS. 5 and 6, a locking pin assembly 480 is movably connected to second plate for fixing the position of second plate 240 after first pair of wheels 300 are moved into contact with flange 150. Locking pin assembly 480 includes an integrally attached extension 490 receivable in notch 450 and also has an outwardly protruding pin 495 sized to engage either of apertures 255*a,b*. In this regard, extension 490 of locking pin 480 engages notch 450 as pin 495 engages aperture 255*a*. Moreover, pin 495 can be disengaged from aperture 255*a* and moved upwardly to be engaged with aperture 255*b* for maintaining extension 490 out of notch 450 so that second plate 240 is precisely movable either toward or away from rail 140 as lead screw 460 rotates.

Figure 7:
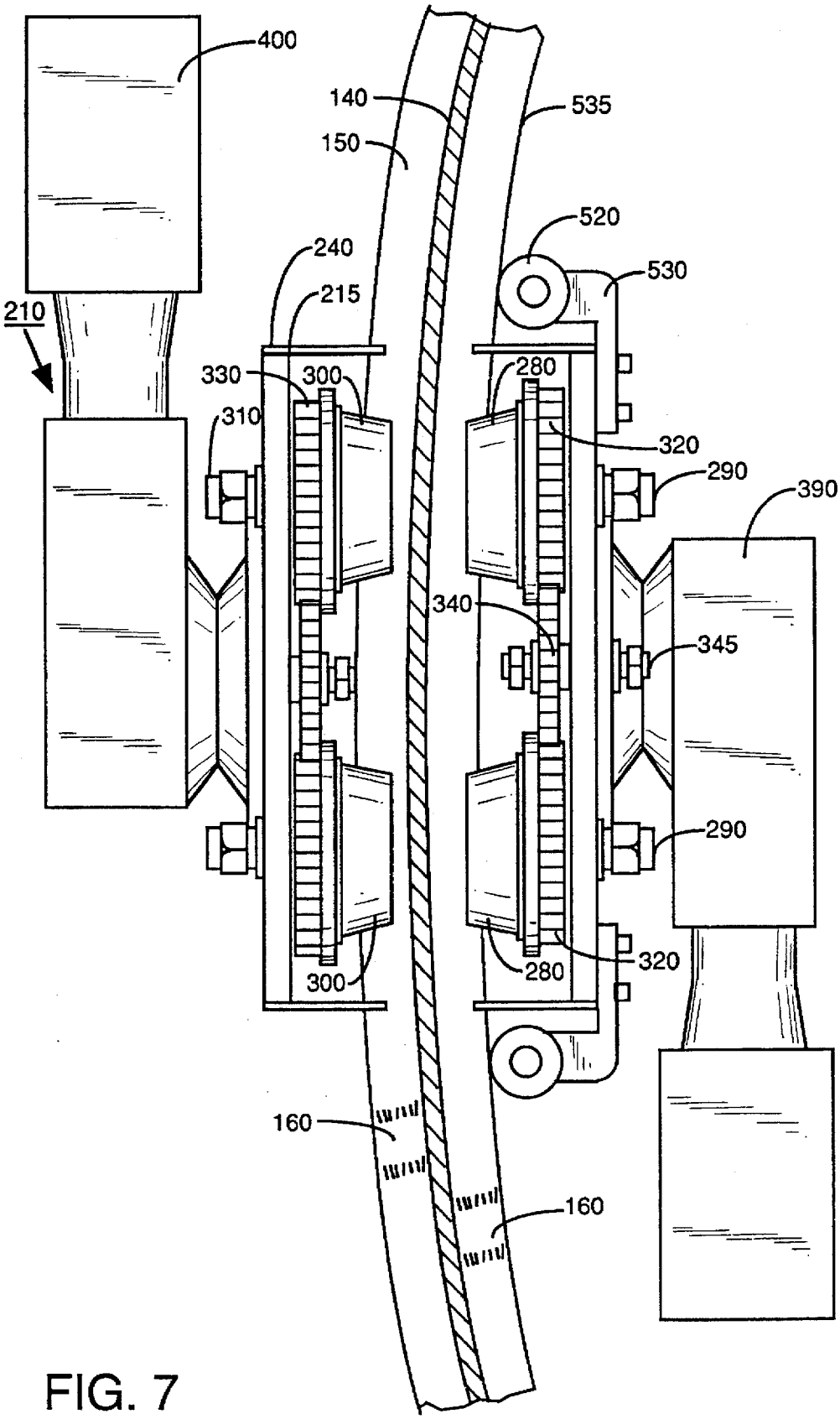
FIG. 7 is a view section line 7—7 of FIG. 4.

Referring to FIG. 7, a pair of follower wheels 520 are connected to first plate 230, such as by brackets 530, for engaging the inner curvature 535 of the circular rail 140, so that wheel assembly 210 is capable of precisely following the curvature of rail 140.

Referring to FIGS. 1, 2, 3, 4, 5 and 6, a hoist assembly 500 is connected to wheel assembly 210 and engages a cable 510 connectable to pretensioning device 130 for hoisting pretensioning device 130 onto stud 100.

OPERATION

Rail 140 is positioned above closure head 60 and support legs 170 are connected to attachment members 90. Wheel assembly 210 having hoist 500 connected thereto is then positioned on rail 140. Cable 510 is connected to pretensioning device 130 for hoisting pretensioning device 130 onto a selected one of studs 100. Pretensioning device 130 is operated to engage end portion 110 of stud 100 for pretensioning stud 100 prior to running nut 120 down stud 100.

In order to connect wheel assembly 210 to rail 140, first pair of wheels 280 are placed on flange 150 by any convenient means. Thereafter, handle 470 is turned to rotate lead screw 460. As lead screw 460 rotates, it engages internal threads 440 of sleeve 430. As internal threads 440 are engaged by lead screw 460, second plate 240 belonging to frame 215 will advance toward rail 140 until second pair of wheels 300 engage or contact flange 150. After second pair of wheels 300 contact flange 150, locking pin assembly 480 is downwardly moved so that pin 495 engages aperture 255*a* and so that extension 490 engages notch 450 for locking plates 230/240, and wheels 280/300, in position on flange 150.

First motor 390 and second motor 400 are electrically energized by operating controller 410. As first motor 390 operates, it rotates first drive gear 350, which in turn rotates idler gear 340 because first drive gear 350 engages idler gear 340. As idler gear 340 rotates, first driven gears 320 rotate because idler gear 340 engages first driven gears 320. First pair of wheels 280 rotate as first driven gears 320 rotate because first pair of wheels 280 are connected to first driven gears 320. As second motor 400 operates, it rotates second drive gear 370, which in turn rotates second driven gears 330 because second drive gear 330 engages second driven gears 330. Second pair of wheels 300 rotate as second driven gears 330 rotate because second pair of wheels 300 are connected to second driven gears 330.

Wheel assembly 210 traverses around rail 140 as first pair of wheels 280 and second pair of wheels 300 rotate because first pair of wheels 280 and second pair of wheels 300 engage flange 150. However, as first pair of wheels 280 and second pair of wheels 300 traverse rail 140, at least one of the wheels 280/300 may encounter raised, bumpy or uneven portion 160 in flange 150. Wheels 280/300 will traverse uneven portion 160 without slippage or loss of traction because frame 215, which comprises first plate 230 and second plate 240 and which has wheels 280/300 connected thereto, will pivot about pivot axis 468. As frame 215 pivots about pivot axis 468, wheel assembly 210 will ride over uneven portion 160 without loss of traction.

It will be appreciated from the description hereinabove that an advantage of the present invention is that wheels 280/300 maintain engagement with rail 140 as wheels 280/300 traverse uneven portion 160 and as frame 215 pivots about pivot axis 468, so that the wheel assembly 210 traverses the rail without slippage for precisely traversing rail.

It will also be appreciated that another advantage of the present invention is that adjustment means 420 allows wheel assembly 210 to be quickly mounted on and dismounted from rail 140 in the manner disclosed hereinabove.

Although the invention is illustrated and described herein in its preferred embodiment, it is not intended that the invention as illustrated and described be limited to the details shown, because various modifications may be obtained with respect to the invention without departing from the spirit of the invention or the scope of equivalents thereof. For example, although wheel assembly 210 is described herein for use on a circular rail disposed above a nuclear reactor pressure vessel to assist in hoisting a pretensioning tool, wheel assembly 210 is usable on any similar rail whether or not the rail is disposed above a reactor pressure vessel and whether or not it is used to hoist a pretensioning tool.

Therefore, what is provided is a wheel assembly capable of maintaining engagement with a rail as the wheel assembly traverses an uneven portion in the rail, which rail may be a circular rail disposed above a nuclear reactor pressure vessel for suspending service tooling from the rail to service the pressure vessel.

I claim:

1. A wheel assembly capable of maintaining engagement with a circular rail having an inner curvature as the wheel assembly traverses an uneven portion in the rail, comprising:

(a) a frame having a fixed first portion and a movable second portion, said frame defining a pivot axis therethrough;

(b) a plurality of wheels rotatably connected to said frame for engaging the rail and traversing therealong; and (c) adjustment means connected to said frame for adjusting said wheels, so that said wheels engage the rail, whereby said frame and said wheels traverse the rail as said wheels simultaneously rotate, whereby said frame and said wheels pivot about the pivot axis as at least one of said wheels traverse the uneven portion in the rail, and whereby said wheels maintain engagement with the rail as the at least one of said wheels traverses the uneven portion and as said frame pivots about the pivot axis, said adjustment means including a sleeve attached to the first portion of said frame, said sleeve having internal threads and a notch formed therein; and a rotatable lead screw rotatably connected to the second portion of said frame and disposed in said sleeve and threadably engaging the internal threads formed therein for controllably advancing the second portion of said frame toward the rail, so that said wheels contact the rail.

2. The wheel assembly of claim 1, further comprising a locking pin movably connected to the second portion of said frame and receivable in the notch formed in said sleeve for locking said frame in position on the rail.

3. The wheel assembly of claim 1, further comprising a plurality of motors engaging respective ones of said wheels for rotating said wheels.

4. The wheel assembly of claim 1, further comprising a follower wheel connected to said frame and engaging the inner curvature of the circular rail for allowing said frame to precisely follow the curvature of the rail.

5. For use in a power plant, a wheel assembly capable of maintaining engagement with a circular rail as the wheel assembly traverses an uneven portion of the rail, the rail defining an inner curvature, the wheel assembly having a hoist connected thereto for hoisting a tool usable for servicing the power plant, comprising:

(a) a frame defining a pivot axis therethrough, including:

(i) a fixed first plate;

(ii) a movable second plate, said second plate spaced-apart from said first plate and disposed parallel and opposite said first plate;

(b) a first pair of wheels rotatably connected to said first plate for engaging the rail and traversing around the rail;

(c) a second pair of wheels rotatably connected to said second plate for engaging the rail and traversing around the rail;

(d) adjustment means connected to said second plate for adjusting said second pair of wheels, so that said second pair of wheels engage the rail, said adjustment means including:

(i) a sleeve attached to said second plate, said sleeve having internal threads and a notch formed therein; and (ii) a rotatable lead screw rotatably connected to said second plate and disposed in said sleeve and threadably engaging the internal threads formed therein for controllably advancing said second plate toward the rail, so that said second pair of wheels contact the rail; and (e) a locking pin movably connected to said second plate and receivable in the notch for locking said second plate in position on the rail after said second pair of wheels contact the rail, whereby said frame and said first pair of wheels and said second pair of wheels traverse around the rail as said first pair of wheels and said second pair of wheels simultaneously rotate, whereby said frame and said first pair of wheels and said second pair of wheels pivot about the pivot axis as at least one of said first pair of wheels and said second pair of wheels traverse the uneven portion in the rail, and whereby said first pair of wheels and said second pair of wheels maintain engagement with the rail as the at least one of said first pair of wheels and said second pair of wheels traverses the uneven portion and as said first and second plates pivot about the pivot axis.

6. The wheel assembly of claim 5, further comprising:

(a) a pair of rotatable first driven gears attached to respective ones of said first pair of wheels, so that said first pair of wheels rotate as said first driven gears rotate;

(b) a pair of rotatable second driven gears attached to respective ones of said second pair of wheels, so that said second pair of wheels rotate as said second driven gears rotate;

(c) a circular rotatable idler gear interposed between said first driven gears for simultaneously engaging said first driven gears, so that said first driven gears rotate as said idler gear rotates;

(d) a rotatable first drive gear engaging said idler gear for rotating said idler gear; and (e) a rotatable second drive gear interposed between said second driven gears for simultaneously engaging said second driven gears, so that said second driven gears rotate as said second drive gear rotates.

7. The wheel assembly of claim 6, further comprising:

(a) a variable speed reversible first motor connected to said first drive gear for rotating said first drive gear; and (b) a variable speed reversible second motor connected to said second drive gear for rotating said second drive gear.

8. The wheel assembly of claim 5, further comprising a follower wheel connected to said frame and engaging the inner curvature of the circular rail for allowing said frame to precisely follow the curvature of the rail.

* * * * *